United States Patent [19]

Dowker

[11] 4,187,978

[45] Feb. 12, 1980

[54] MAILBOX PROTECTIVE APPARATUS

[76] Inventor: Raymond A. Dowker, Rte. 3, Box 369, Charlotte, Mich. 48813

[21] Appl. No.: 907,755

[22] Filed: May 19, 1978

[51] Int. Cl.[2] ..... B65D 91/00

[52] U.S. Cl. ..... 232/39; 248/145

[58] Field of Search ..... 232/38, 39; 248/145

[56] References Cited

U.S. PATENT DOCUMENTS

| | | | |
|---|---|---|---|
| 1,337,089 | 4/1920 | Murray | 248/145 |
| 1,411,867 | 4/1922 | Munson | 232/39 |
| 1,790,136 | 1/1931 | Dalrymple | 248/145 |
| 2,216,408 | 10/1940 | Elmer | 248/145 |
| 3,881,650 | 5/1975 | Schmidt | 232/39 |
| 3,999,702 | 12/1976 | Conray | 232/39 |

*Primary Examiner*—Roy D. Frazier
*Assistant Examiner*—Peter A. Aschenbrenner
*Attorney, Agent, or Firm*—Robert Brown, Jr.

[57] ABSTRACT

Apparatus for protecting cantilevered mailboxes from damage caused by collision with passing vehicles, maintenance equipment and other objects thrown by the plows against the boxes while clearing the roadways. More specifically, the apparatus includes a vertically disposed column anchored in the ground and a laterally projecting arm hingedly secured to the upper portion of the column for swingably supporting the mailbox. A shear pin normally locks the hinge and associated arm and box against rotation. The pin is designed to shear in response to a predetermined torsional stress upon the hinge which stress is produced by the impact of a vehicle or other object striking the box or arm thereby permitting the box and arm to swing to non-obstructing position as the object passes.

The apparatus is further characterized by flexible shields or a cage surrounding at least a portion of the mailbox and adapted to absorb or damp at least a portion of the initial collisional impact, thus relieving the shear pin from a corresponding torsional stress even if the ultimate stress is sufficient to shear the pin, said shield being coated with a safety orange or other iridescent material to facilitate identification by an approaching driver.

5 Claims, 12 Drawing Figures

MAILBOX PROTECTIVE APPARATUS

The present apparatus is designed and built to eliminate costly damage to rural mailboxes and the supports therefor when accidentally hit by moving vehicles and projectiles. Conventional rural mailboxes are usually cantilevered upon an inverted L-shaped support which bends or breaks rather than yields to a collisional impact, resulting in severe damage or complete destruction. Numerous attempts have been made to overcome such a defect by confining the box-supporting arm in normal mail-receiving position under spring pressure which permits the box to swing to non-obstructing position under impact and then automatically returns it to normal position. U.S. Pat. Nos. 1,522,830; 2,936,143; 3,658,284 and 3,802,656 are examples of such a construction. But even these attempted solutions often create problems more serious than those which previously existed. Although the concept of permitting the box to yield rather than bend or break is a desirable characteristic, the incorporation of a spring or yieldable element into the hinge mechanism is not only complex and expensive to manufacture and maintain, but it also limits or destroys a highly essential required amount of minimum rigidity which should be maintained to prevent the hinge from yielding to numerous impacts and stresses insufficient to cause damage to the box and support.

So far as applicant is aware, no prior device has been provided which utilizes a shear pin for maintaining a predetermined rigidity in mailbox supports of the class described and adapted to prevent yielding of the support until subjected to an impact or stress sufficient to shear the pin. Neither is applicant aware of such a construction in combination with a flexible shield disposed in spaced relation to the box and adapted to absorb the less severe impacts from objects and thereby more gradually transmit the impacts to the shear pin.

It is therefore an object of this invention to provide an improved mailbox protective assembly which eliminates or substantially reduces the aforementioned problems inherent in certain prior art devices.

It is another object of invention to provide a protective support of the class described which is rigidly held by a shear pin in normal position for receiving mail from a delivery vehicle on an adjacent roadway until subjected to a predetermined impact sufficient to shear the pin and release the support and box from fixed position.

It is another object of invention to provide an assembly such as described in the immediately preceding paragraph, in combination with a flexible shield or guard for receiving the initial impact of a collisional object and for damping or absorbing at least a portion of the impact which otherwise would be transmitted to the shear pin.

It is a still further object of invention to provide a mailbox assembly of the class described in which the flexible shield is coated with a safety orange or other iridescent color so as to enhance visibility and assist drivers of aproaching vehicles to more easily identify the assembly thereby reducing the liklihood of accidental collision. This added feature is especially important inasmuch as one of the major causes of mailbox damage is due to poor visibility at night and/or during adverse weather conditions.

It is yet another object of invention to provide an improved mailbox assembly of the class described which is simple in construction, economical to manufacutre and maintain, and efficient in operation.

Some of the objects of invention having been stated, other objects will appear as the description proceeds when taken in connection with the accompanying drawings, in which, FIG. 1 is a side elevation of a mailbox cantilevered upon my improved protective support;

Figure 1:
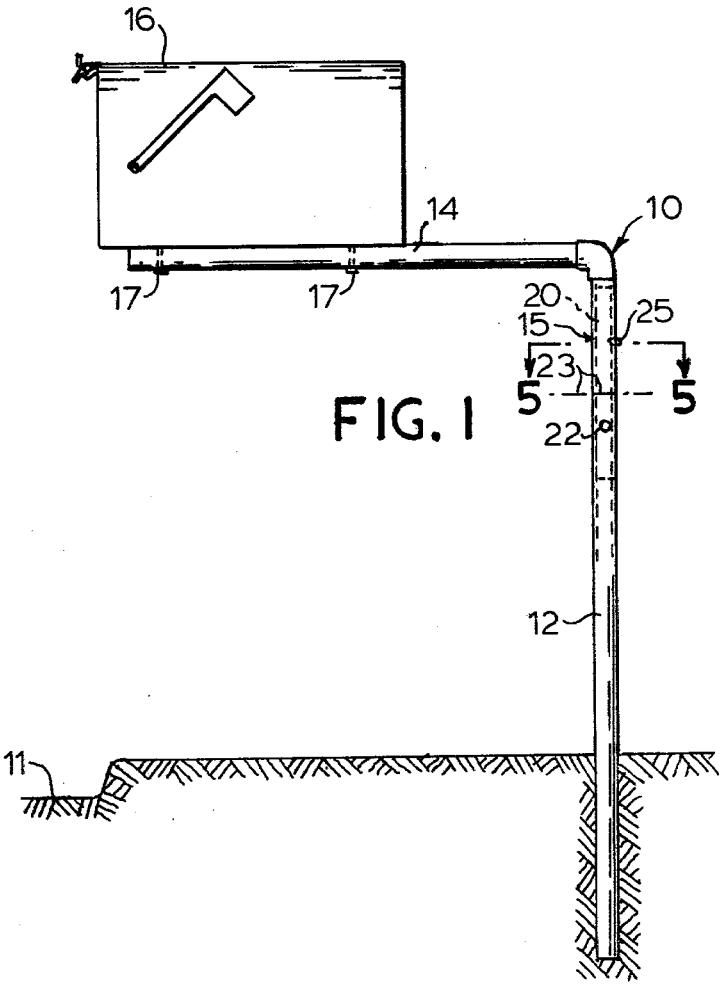

Applicant's mailbox assembly 10 is shown in FIG. 1 located alongside a roadway 11 so as to be accessible to the driver of a delivery or other passenger vehicle. More particularly, the assemby comprises a vertically disposed pipe column 12 having a cantilevered arm 14 mounted on the upper portion thereof for horizontal movement by means of a hinge 15, said arm having a conventional mailbox 16 mounted upon its outer free end portion by any suitable means such as bolts or screws 17.

Figure 4:
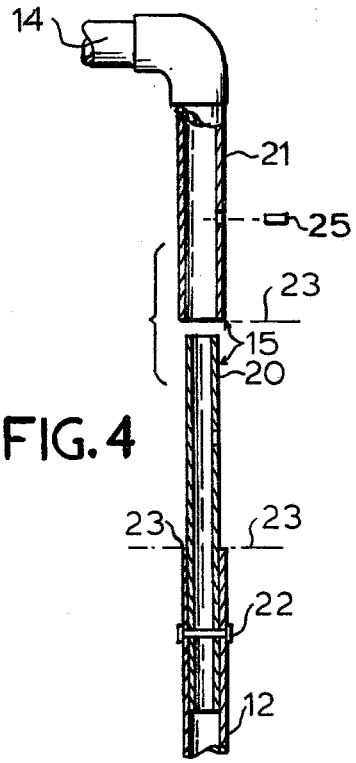
FIG. 4 is an exploded vertical sectional detail view of the intermediate portion of FIG. 1.
Figure 2:
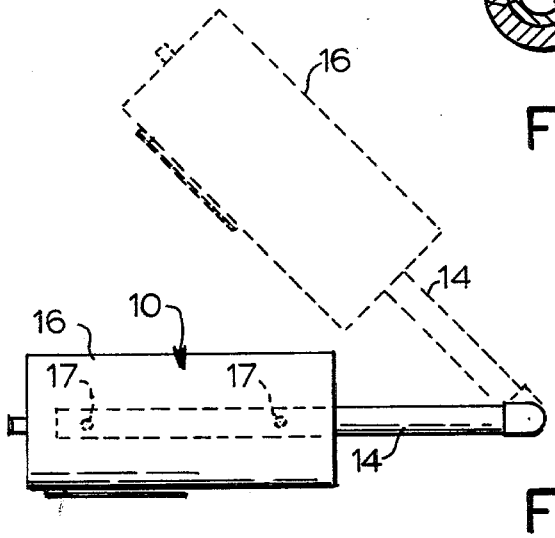
FIG. 2is a top plan view of FIG. 1 and further showing in dotted lines the box and its supporting arm in a displaced position caused by a collisional impact of a striking object.
Figure 5:
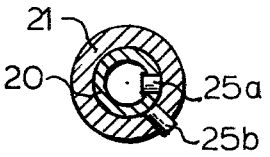
FIG. 5 is an enlarged sectional plan view taken along line 5—5 in FIG. 1, but showing the shear pin broken as when the mailbox is displaced in dotted line position in FIG. 2.
Figure 3:
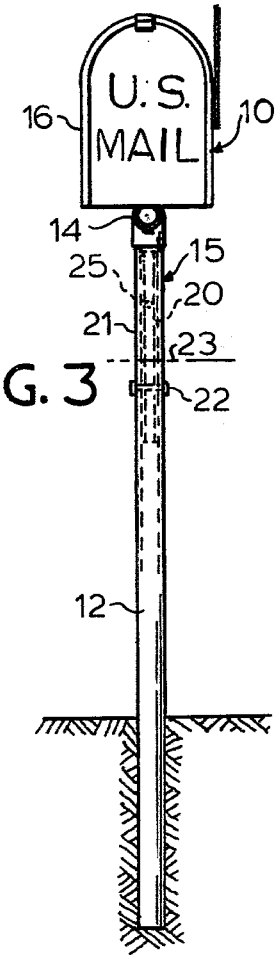
FIG. 3 is a front elevation looking at the lefthand side of FIG. 1.

Hinge 15 is composed of a relatively short pipe or spindle 20 axially alined with and projecting upwardly from the inside of pipe 12 and then into a second axially alined short pipe 21, the latter pipe having the inner end of arm 14 secured thereto (See also FIGS. 3–5). The spindle 20 has an outside diameter substantially the same as the inside diameters of pipes 12 and 20, the lower end portion of the spindle being fixedly secured to pipe 12 by any suitable means such as bolt or rivet 22 and its upper end portion supporting relatively rotatable pipe 21 and arm 14. Pipes 12 and 21 abut one another as at 23 along a horizontal plane.

The assembly 10 is releasably held in its normal mail-receiving position by a shear pin 25 which is designed to withstand a predetermined torsional stress about the axis of hinge 15 before breaking, as more fully described later. When, however, the mailbox 16 and the arm 14 are subjected to an impact of predetermined intensity from a collisional object, a corresponding torsional stress is transmitted to the hinge through the shear pin 25, causing the pin to shear into pieces **25*a* and 25*b***

(FIG. 5) to permit the box and arm to swing to a non-obstructing position. The diameter or cross-sectional area of shear pin 25 for any particular assembly model depends upon factors such as the unit shear strength of the material from which the pin is made, and the predetermined impact against which the components of the assembly are to be shielded or protected. Ordinarily, the column 12 and arm 14 will withstand a higher impact without damage than the box 16; consequently, if protection from damage to both components is desired, a pin is designed having a shearing strength corresponding to the lower impact that the box will withstand. After ascertaining this lower impact, the corresponding torsional stress along the axis of hinge 15 is computed and from the latter the pin size is determined. Although the shear pin may be formed from various materials, wood has been found to be especially suitable because of its availability and low cost, as well as the ease with which an employee of the highway maintenance department or the personal owner may install it. On the other hand, if it is only desired to protect the support members 12, 14 and 15, the shear pin would be larger corresponding to the higher predetermined permissible impact.

Figure 7:
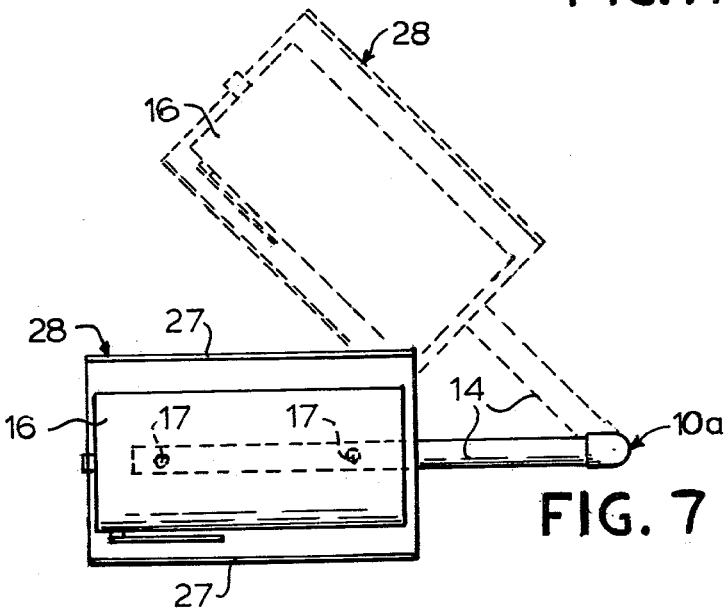
FIG. 7 is a top plan view of FIG. 6, and also showing in dotted lines the box, arm and shield in laterally dislaced position.
Figure 8:
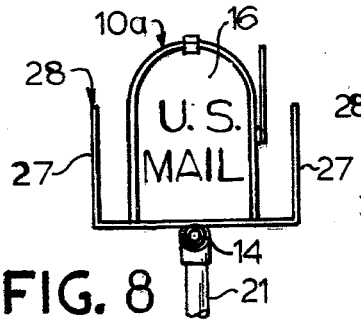
FIG. 8 is a front elevation of FIG. 6.
Figure 6:
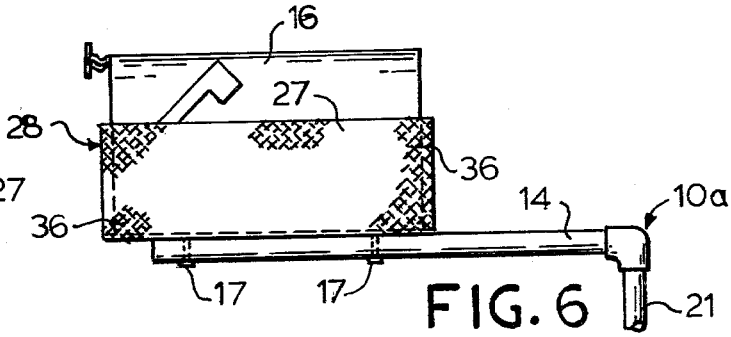
FIG. 6 is a side elevation similar to FIG. 1, but showing a modified form of invention in which a flexible guard or shield is employed to protect the box from the initial impact of a collisional object.

FIGS. 6–8 show the mailbox assembly 10*a* in combination with flexible guards or shields 27 which absorb or damp the initial impact of collisional objects, serving to prevent contact by the objects with the mailbox 16 in response to relatively low impact stresses and to reduce the total impact transmitted to the shear pin even though insufficient to shear the pin. Where the collisional object strikes the shield with sufficient force to ultimately shear the pin 25, the shields 27 serve as a primary resistance against the initial shock and the shear pin as a secondary residual resistance. More particularly, the guards or shields 27 comprise the upstanding legs of a U-shaped member 28, said legs being disposed respectively in spaced relation and parallel to the opposite side faces of the mail box. Thus when an object strikes the outer face of either shield, the latter will bend inwardly toward the box to absorb at least a portion of the impact.

Figure 10:
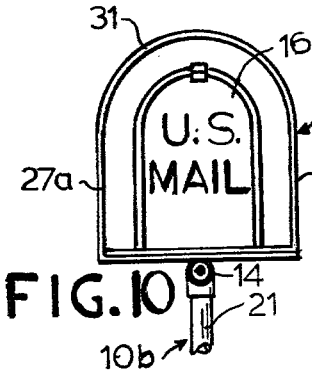
FIG. 10 is a front elevation of the mailbox and support shown in FIG. 9.
Figure 9:
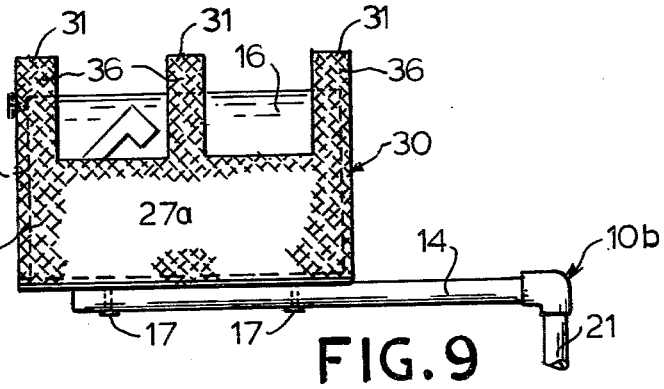
FIG. 9 is an elevational view similar to FIG. 6, but showing another modified form of invention.

FIGS. 9 and 10 show a one-piece shield or guard forming a cage about the mailbox 16, said shield being provided with upstanding legs 27*a*, 27*a* disposed respectively parallel and in spaced relation to the opposite side faces of the box substantially in the same manner as previously described in connection with legs 27, 27 in FIGS. 6–8. The upper ends of legs 27*a*, 27*a* are connected by arcuate flexible members 31 extending over the box. Thus, a portion of the impact from an object striking a leg 27*a* on one side of the box will be transmitted to the oppositely disposed leg 27*a* through flexible spring members 31.

Figure 12:
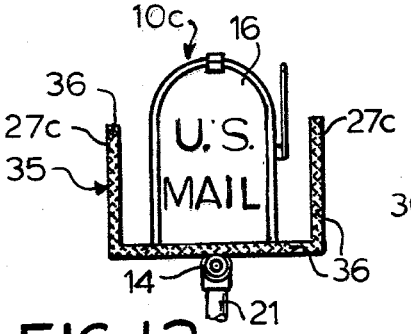
FIG. 12 is an elevational view looking at the lefthand side of FIG. 11.
Figure 11:
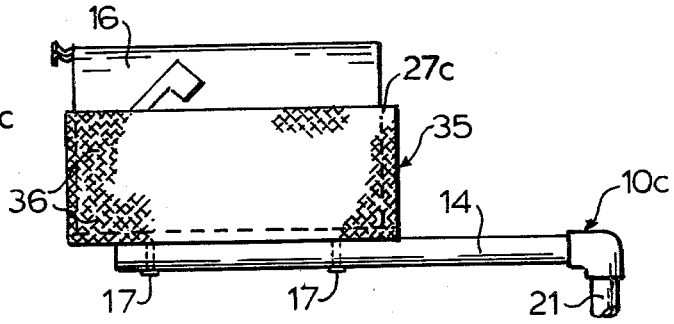
FIG. 11 is a view similar to FIG. 6, but showing the shield made from a thicker layer of flexible construction such as a molded plastic.

FIGS. 11, 12 and 12A show a flexible U-shaped shield 35 similar to the shield 28 in FIGS. 6–8 molded from a suitable plastic or resinous material, said shield having upstanding parallel legs 27*c*, 27*c*.

For reasons previously stated, the outer surfaces of each of the shields 28, 30 and 35 are preferaby provided with an orange or other iridescent coating 36 to enhance visibility, especially at night, and to assist the drivers of approaching vehicles in avoiding collision with the mailbox assemblies.

I claim:

1. In a mailbox assembly having a vertically disposed support column, an arm cantilevered from the upper portion of said column, and a mailbox mounted upon the outer end portion of said arm, apparatus for protecting said assembly from collisional impacts by objects such as snow plows and propelled snow, comprising means for hingedly securing said arm for lateral swinging movement about said column;

a shear pin for releasably locking said hinge and associated arm and mailbox against swinging movement;

said pin being shearable in response to a predetermined torsional stress about the axis of said hinge under the collisional impact of said objects to thereby release the hinge and box from locked position;

spring means for damping the initial impact of said collisional objects;

said spring means comprising a pair of upwardly extending plate shields respectively disposed on opposite sides and in spaced relation to said box;

means for fixedly anchoring the lower marginal portions of said plates to said arm whereby said collisional impact will deflect the shields inwardly toward the box, and struts extending laterally of said box and connecting the upper marginal edges of said shields whereby a part of the impact upon one of the shields will be transmitted to the other.

2. The apparatus defined in claim 1 wherein said plate shields are coated with an iridescent material to enhance visibility of the assembly by drivers of vehicles and maintenance equipment at night.

3. In a mailbox assemby havng a vertically disposed support column, an arm cantilevered from the upper portion of said column, and a mailbox mounted upon the outer end portion of said arm, apparatus for protecting said assembly from collisional impacts by objects such as snow plows and propelled snow, comprising means for hingedly securing said arm for lateral swinging movement about said column;

a shear pin for releasably locking said hinge and associated arm and mailbox against swinging movement;

said pin being shearable in response to a predetermined torsional stress about the axis of said hinge under the collisional impact of said objects to thereby release the hinge and box from locked position;

spring means for damping the initial impact of said collisional objects;

said spring means including a U-shaped shield, the trough portion of said shield supporting the bottom of said box and the respective leg portions thereof being disposed in proximate spaced relation to the opposite sides of the box, and means for fixedly anchoring the shield to said box and arm.

4. The apparatus defined in claim 3 and further comprising struts extending laterally of said box and connecting the upper marginal edge portions of said leg portions whereby a part of the impact upon one of the leg portions will be transmitted to the other.

5. The apparatus defined in claim 3 wherein said shield is coated with an an iridescent material to enhance visibility by drivers of vehicles and of maintenance equipment.

* * * * *